US009441369B2

(12) United States Patent
Shaw

(10) Patent No.: US 9,441,369 B2
(45) Date of Patent: Sep. 13, 2016

(54) FIXTURE-SUPPORTING RAIL FOR SUSPENDED CEILINGS

(71) Applicant: Springdale Electric Ltd., Brampton (CA)

(72) Inventor: Douglas Shaw, Grand Valley (CA)

(73) Assignee: Springdale Electric Ltd., Brampton (CA)

( * ) Notice: Subject to any disclaimer, the term of this patent is extended or adjusted under 35 U.S.C. 154(b) by 0 days.

(21) Appl. No.: 14/887,636

(22) Filed: Oct. 20, 2015

(65) Prior Publication Data

US 2016/0115689 A1 Apr. 28, 2016

Related U.S. Application Data

(60) Provisional application No. 62/068,154, filed on Oct. 24, 2014.

(51) Int. Cl.

| | |
|---|---|
| ***F21S 8/02*** | (2006.01) |
| ***E04B 9/00*** | (2006.01) |
| ***E04B 9/06*** | (2006.01) |
| ***E04B 9/18*** | (2006.01) |
| ***E04B 9/24*** | (2006.01) |

(52) U.S. Cl.

CPC ..... *E04B 9/006* (2013.01); *E04B 9/06* (2013.01); *E04B 9/18* (2013.01); *E04B 9/24* (2013.01)

(58) Field of Classification Search

CPC ..... F21S 8/026; F21S 8/02; F21Y 2101/02; E04B 9/006; F21V 21/04; F24F 13/072

See application file for complete search history.

(56) References Cited

U.S. PATENT DOCUMENTS

| | | | | |
|---|---|---|---|---|
| 4,493,171 | A * | 1/1985 | Stahlhut | E04B 9/32 362/150 |
| 4,494,175 | A * | 1/1985 | Gawad | F21S 8/02 362/148 |
| 6,568,826 | B1 * | 5/2003 | Kotovsky | F21S 8/02 362/147 |
| 6,979,097 | B2 * | 12/2005 | Elam | F21S 2/00 362/148 |
| 7,120,269 | B2 * | 10/2006 | Lowell | H04R 1/025 181/171 |
| 7,413,322 | B2 * | 8/2008 | McCarthy | F21V 29/02 362/147 |
| 9,060,607 | B1 * | 6/2015 | Canales | A47F 5/0006 |

* cited by examiner

*Primary Examiner* — Rodney Mintz
*Assistant Examiner* — Daniel Kenny
(74) *Attorney, Agent, or Firm* — Bejin Bieneman PLC

(57) ABSTRACT

There is provided a rail for supporting one or more ceiling panels in a suspended ceiling. The rail comprises an elongate member for supporting the one or more ceiling panels. The elongate member has an upper and a lower surface and has formed therein an opening extending between the upper and lower surfaces for accommodating a fixture or device to be mounted to or within the suspended ceiling.

6 Claims, 6 Drawing Sheets

FIXTURE-SUPPORTING RAIL FOR SUSPENDED CEILINGS

CROSS-REFERENCE TO RELATED APPLICATIONS

This application claims priority to U.S. Provisional Application No. 62/068,154 filed Oct. 24, 2014, which application is hereby incorporated herein by reference in its entirety.

FIELD

The present disclosure relates generally to rails for supporting ceiling panels in suspended ceilings, and in one embodiment to such a rail that also serves to hang a fixture or other device from the ceiling.

BACKGROUND

Suspended or drop ceilings (also referred to as sub-ceilings) are formed by a series of square or rectangular ceiling tiles or panels supported by bottom flanges of inverted T-bar rails. The rails are typically formed from a metal or metal alloy, and are arranged in a grid pattern of main runner rails that are intersected by cross tees or rails. The main runners are suspended from an overhead structure, for example, by metal hang-wire or chain that is passed through one or more openings within the rails and anchored to the overhead structure using, for example, screw eyes. Workmen are required to cut openings within the ceiling tiles to accommodate ceiling fixtures or other devices, including hanging or recessed lights, emergency lights, exit signs, sprinkler heads, smoke and/or CO detectors, and so on. The cut-outs may be of various shapes, such as hexagonal or circular, and result in added labour cost associated with installation of the fixture or device. Installation of a fixture can be tedious overhead work that requires workmen to stand on ladders for extended periods to attach the fixture and/or its associated or supporting box or frame to a support structure disposed above the rails and anchored to a building structure. Given that the ceiling panels are typically installed within the supporting rails during installation of the fixtures, at times the panels can be subject to marring or becoming soiled by workmen during the installation process.

SUMMARY

There is provided a rail for supporting one or more ceiling panels in a suspended ceiling, the rail comprising an elongate member for supporting the one or more ceiling panels, said elongate member having an upper and a lower surface and having formed therein an opening extending between said upper and lower surfaces for accommodating a fixture or device to be mounted to or within the suspended ceiling.

There is also provided a rail for supporting one or more ceiling panels in a suspended ceiling, the rail comprising an elongate member for supporting the one or more ceiling panels, said elongate member having an upper and a lower surface with an opening communicating said upper and lower surfaces, said opening for accommodating a fixture or device to be mounted to or within the ceiling, and an electrical box attached to said upper surface of said elongate member and aligned with said opening, said opening sized and dimensioned to permit access to said electrical box through said opening.

Further there is provided a rail for supporting one or more ceiling panels in a suspended ceiling, the rail comprising an elongate member for supporting the one or more ceiling panels, said elongate member having an upper and a lower surface and having formed therein an opening extending between said upper and lower surfaces for accommodating a fixture or device to be mounted to or within the ceiling, and a pair of flange portions on said upper surface of said elongate member substantially perpendicular to said upper surface, said flange portions positioned on opposite sides of said opening, said elongate member having a ceiling panel support adjacent to each of said flange portions, said ceiling panel support for receiving an edge of one of the one or more ceiling panels to assist in hanging said ceiling panel within said suspended ceiling.

Further aspects of the disclosed subject matter will become apparent from the following description taken together with the accompanying drawings.

BRIEF DESCRIPTION OF THE DRAWINGS

For a better understanding of the present disclosure, and to show more clearly how it may be carried into effect, reference will now be made, by way of example, to the accompanying drawings which show exemplary embodiments in which.

DESCRIPTION

Figure 1:
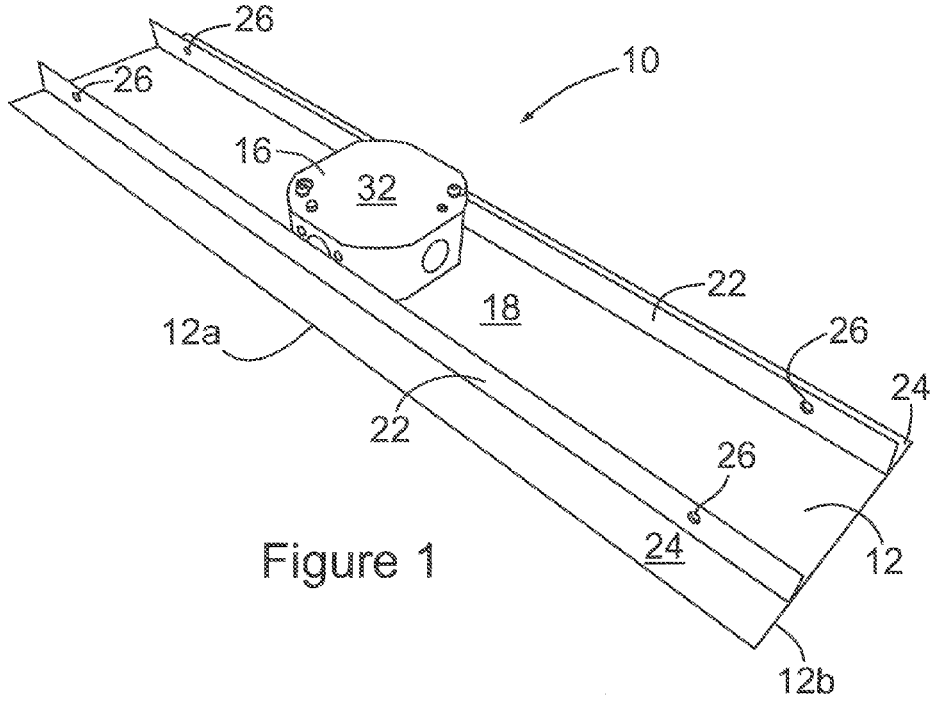
FIG. 1 is a top perspective view of an exemplary fixture-supporting rail.
Figure 2:
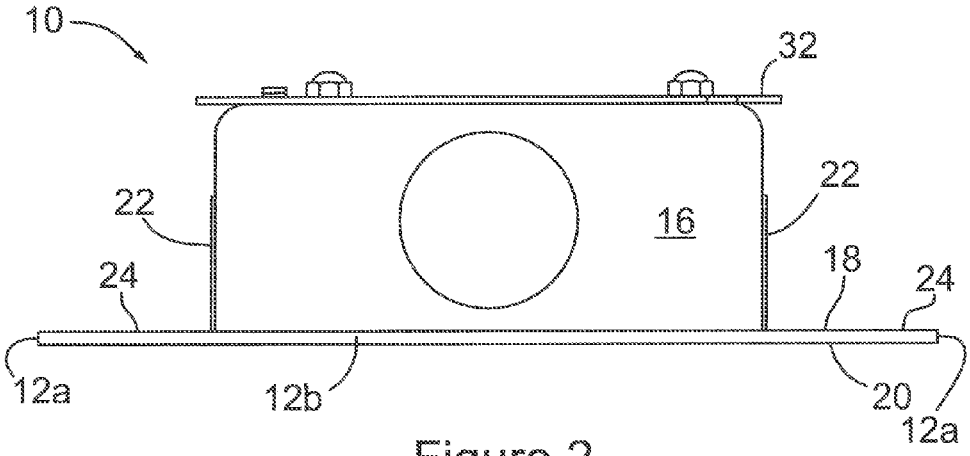
FIG. 2 is an end view of the rail shown in FIG. 1.
Figure 3:
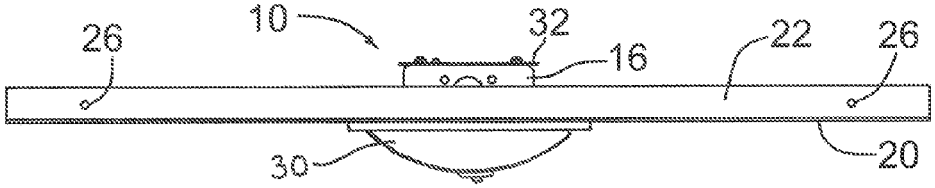
FIG. 3 is a side view of the rail shown in FIG. 1.

The presently disclosed subject matter may be embodied in a number of different forms. The specification and drawings that follow describe and disclose some of the specific forms of the disclosure.

Referring to FIGS. 1 to 9*c*, a rail for supporting ceiling panels in a suspended ceiling is noted generally by reference numeral 10. Rail 10 comprises an elongate member 12, which has formed therein an opening 14. As will be described in more detail below, the elongate member supports one or more ceiling tiles or panels 13 of a suspended ceiling, and is typically a rectangular, planar structure.

Opening 14 accommodates a fixture or other device 30 by receipt of the fixture or device, or a part thereof (such as its wiring) through the opening. For example, in one embodiment, rail 10 includes an electrical box 16. The fixture can then be secured or "hung" from box 16 with the fixture's wires passed through opening 14 for connection to supply wires within the electrical box. In the embodiment shown in the figures, opening 14 is octagonal to accommodate a typical octagon electrical box 16 (e.g., for an electric light fixture, smoke or CO detector, etc.). The electrical box will typically be attached or secured to an upper surface 18 of elongate member 12 through welding, screwing, etc.

In another embodiment, opening 14 may be sized and dimensioned for clearance or passage of a device therethrough that is not required to be wired to an electrical box and/or supported by the rail, such as a sprinkler head. In that case, the device will not be attached to or hung directly from rail 10, but rather, to an alternate structure of the building. In the case of a sprinkler head, the head would be attached to a "drop" extending downward from a water pipe that is attached to the building and which runs above the drop ceiling. In this embodiment, opening 14 is shaped and dimensioned to accommodate the particular device (e.g., sprinkler head) expected to be passed therethrough.

Depending on the type of fixture or device to be installed within the ceiling, various shapes for opening 14 are within the scope of the present disclosure. Various fixture or device types are contemplated to be compatible for use with rail 10, including exit signs, emergency lights, fire and/or smoke detectors, gas (e.g., CO) detectors, security cameras, hanging or recessed lights, alarms, and sprinkler heads. Opening 14 in rail 10 can be sized and dimensioned to accommodate any such fixture or device. Although the particular location of opening 14 along the length and the width of elongate member 12 could vary, it is expected that in most instances the opening will be centralized on member 12.

Rail 10 may further comprise flange portions 22. In the embodiment shown in the figures, the rail comprises two such flange portions. Each flange portion is substantially perpendicular to the elongate member, on opposite sides of the opening, and extends along the length of the elongate member, generally parallel to longitudinal edge 12*a* of member 12. The upper surface 18 of member 12 adjacent of edges 12*a* and flange portions 22 will thus form ceiling panel or tile supports 24.

Figure 4:
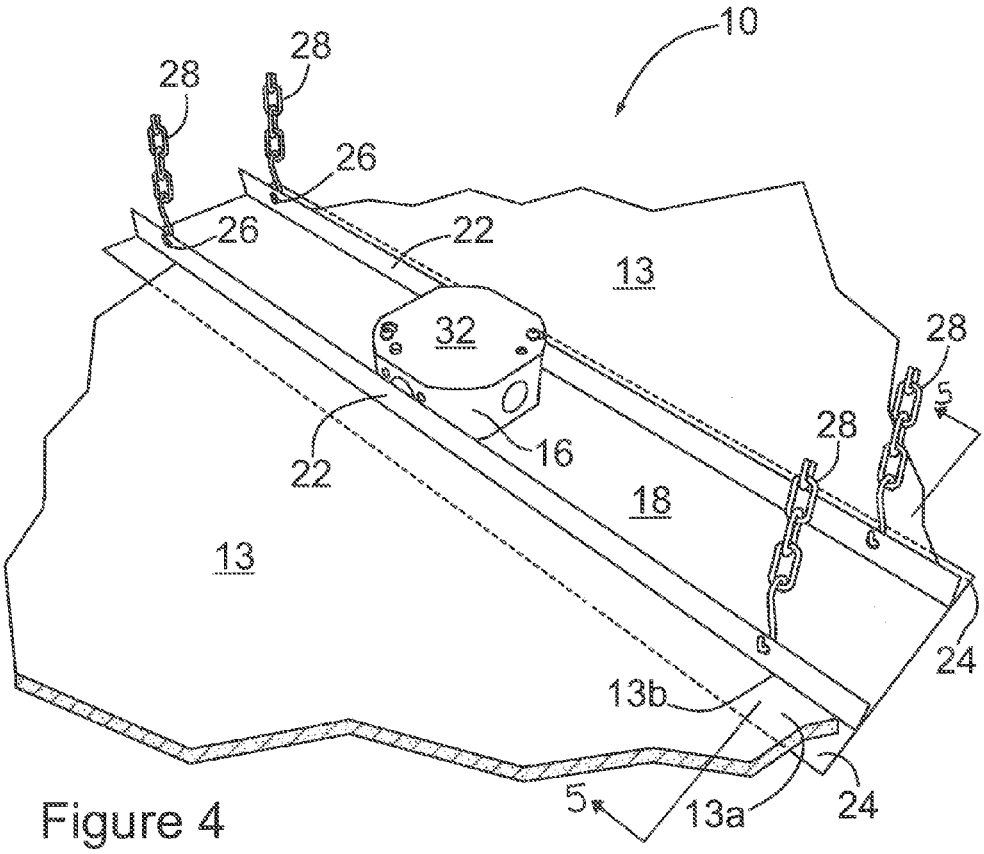
FIG. 4 is a top perspective view of the rail shown in FIG. 1 supporting two ceiling panels and hanging from a structure (not shown)
Figure 5:
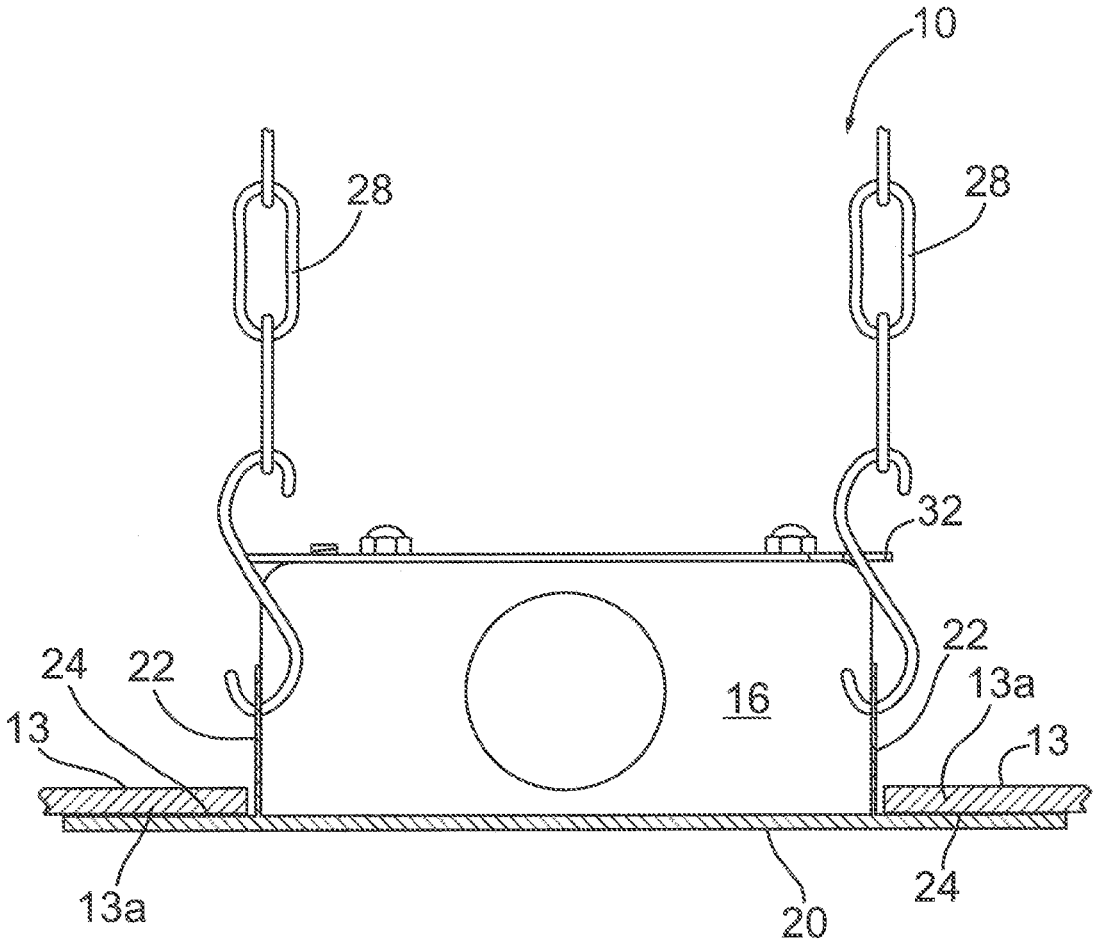
FIG. 5 is a sectional view taken along line 5-5 of FIG. 4.
Figure 6:
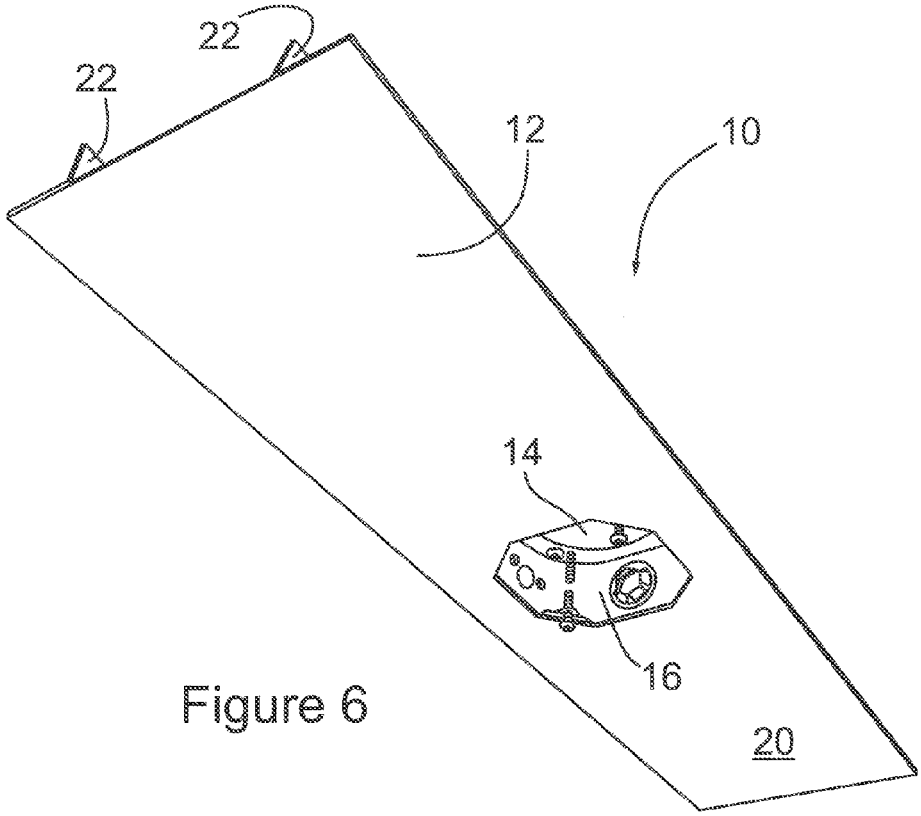
FIG. 6 is a bottom perspective view of the rail shown in FIG. 1.
Figure 7:
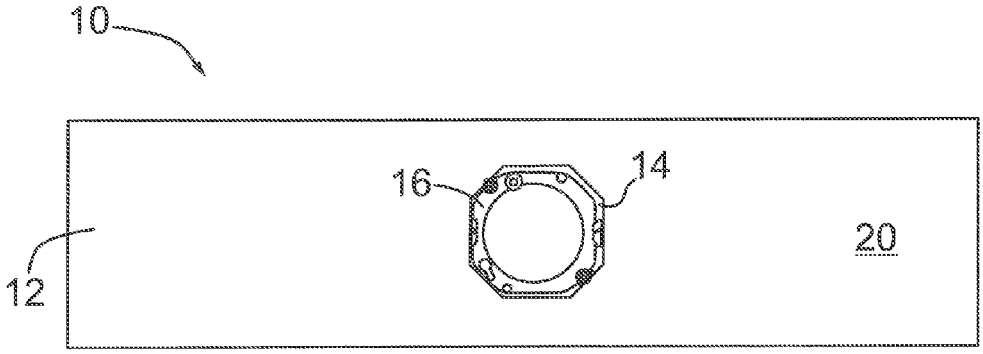
FIG. 7 is a bottom view of the rail shown in FIG. 1.

Supports 24 act as surfaces against which edge portions 13*a* of ceiling panels 13 can lie. As shown in FIG. 4, flange portions 22 of each rail are capable of abutting engagement with ceiling panel edges 13*b* to facilitate alignment of the ceiling panels when supported by the rails.

Referring to FIGS. 1, 3 to 5, and 8, flange portions 22 may include one or more attachment means 26 to assist attachment of rail 10 to a structure above the drop ceiling. In the embodiment shown, there is included a suspension means 28 for hanging the rail from an overhead structure. Here, the attachment means are holes formed in the flange portions for receipt of suspension means such as wire or chain. Flange portions 22 will typically include two or more holes to receive suspension wires or chains. In an alternate embodiment, the attachment means can be formed on or directly attached to the elongate member itself.

Rail 10 will typically be formed from metal and/or metal alloys. However, rail 10 could also be formed from other rigid materials, such as plastic or wood. Further, rail 10 will, in most cases, be painted to match or substantially match the colour of the T-bar rails that are being used.

Rail 10 is dimensioned to cooperatively engage with standard T-bar rails in suspended or drop ceiling installations, in order to support both ceiling panels 13 and fixtures or other devices. Ceiling panels for drop ceilings come in various standard sizes, such as two feet by two feet, four feet by four feet, etc. Rail 10 may be sized and dimensioned to match a length or width dimension of the ceiling panels in any particular drop ceiling application.

Figure 9A:
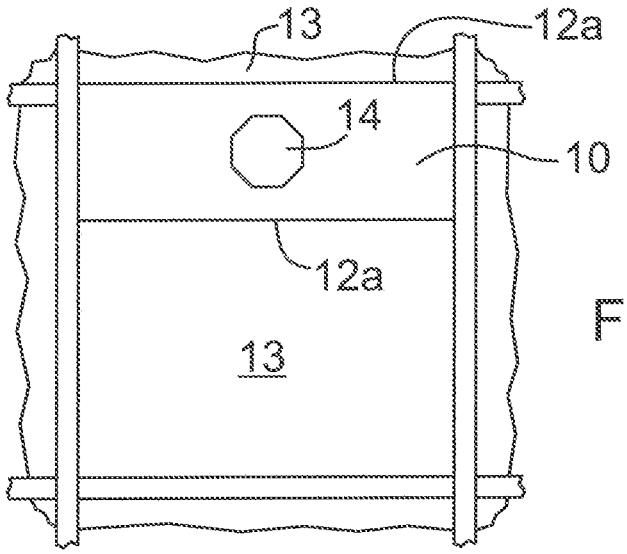
FIGS. 9*a*-9*c* show the rail of FIG. 1 installed in a drop ceiling in three different configurations, from the perspective of a person looking up at the drop ceiling from below.
Figure 9B:
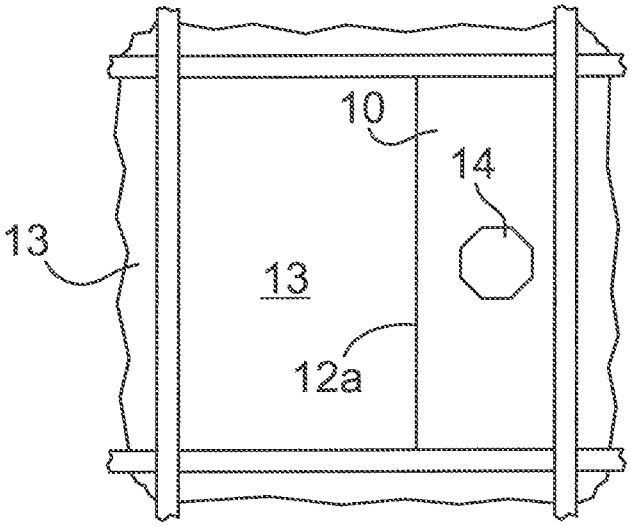
Figure 9C:
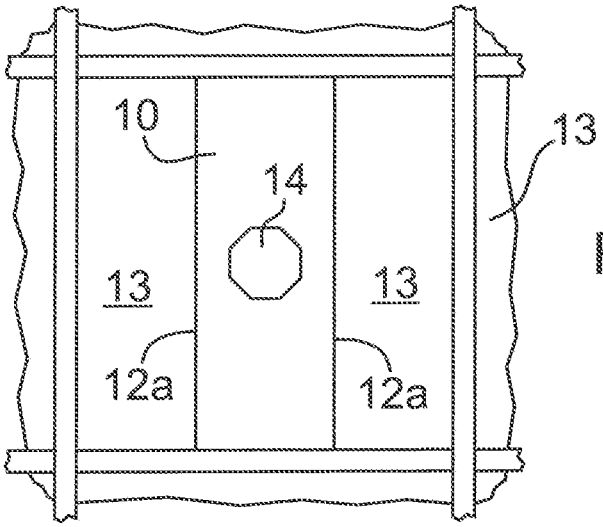

FIGS. 9*a* to 9*c* show three possible arrangements of rail 10 within a drop ceiling installation. It will be appreciated that rail 10 can be suspended from an overhead structure by suspension means 28, and/or transverse edges 12*b* of rail 10 can be supported directly by the T-bar rails. In some installations, rail 10 may additionally be supported by a T-bar rail along longitudinal edge 12*a*, as shown in FIG. 9*b*. Further, rail 10 may be used as a substitute for a T-bar rail, as shown in FIG. 9*a*. While FIGS. 9*b* and 9*c* show two possible positions for the installation of rail 10 where the rail is not replacing a standard T-bar, it will be appreciated that rail 10 can be disposed between the T-bar rails at positions other than those shown in the figures.

As is evident from FIGS. 9*a* to 9*c*, use of rail 10 to support or accommodate fixtures or other devices 30 will obviate the need to make intricate cuts within ceiling panels 13. An installer of a fixture or device need only mount the rail within the T-bar structure and not be concerned with cutting tiles.

When installing a fixture or device (e.g., hanging an exit light), the installer will be able to install the fixture or device in electrical box 16 on the ground or in a workshop, and thereafter insert the entire rail 10, with the fixture or device attached to electrical box 16 or otherwise secured to rail 10, into the T-bar structure. The need to work on the light fixtures overhead (e.g., while on a ladder), and after installation of ceiling panels 13, is largely eliminated. Use of rail 10 is therefore expected to make the installation process easier and faster, resulting in increased efficiency.

Figure 8:
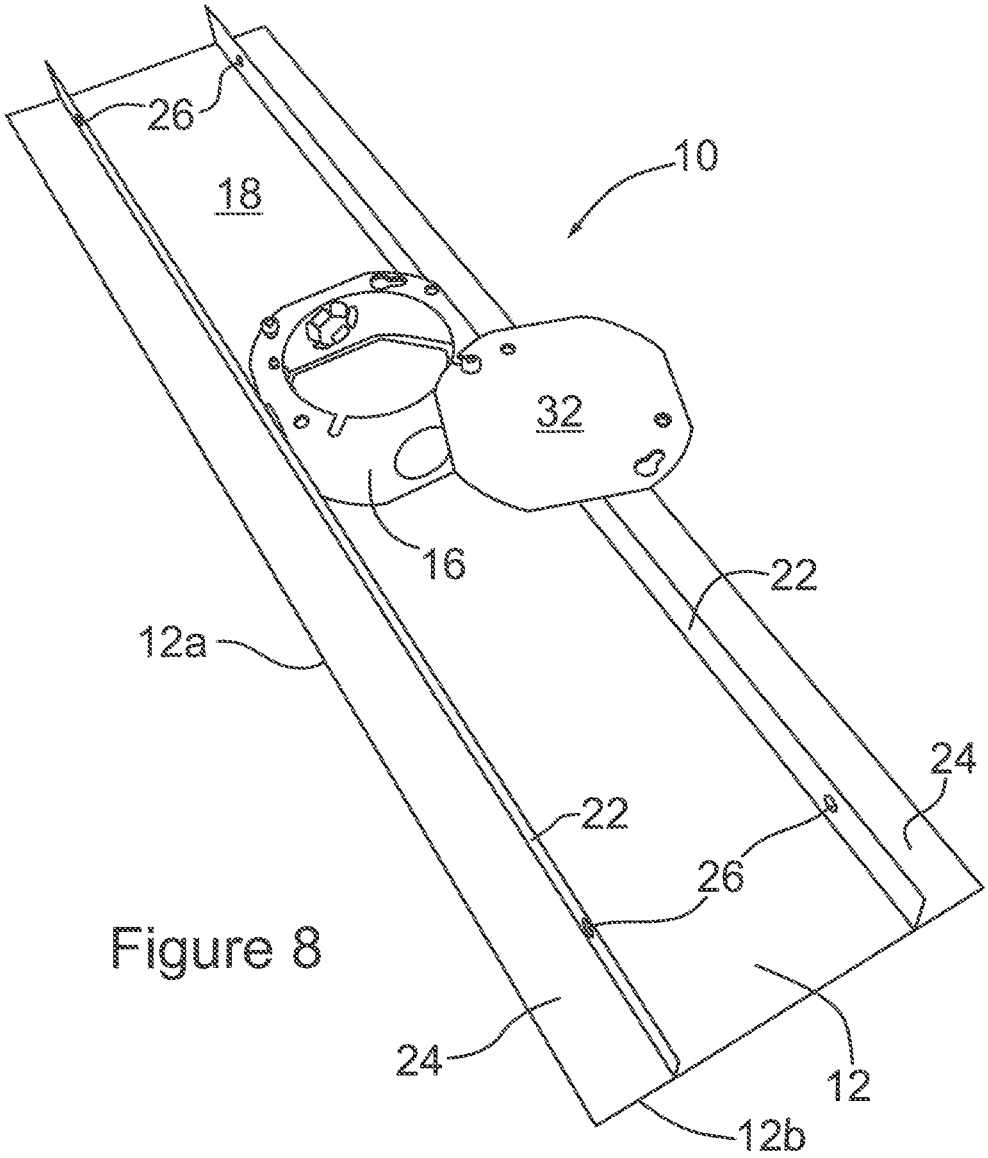
FIG. 8 is a top perspective view of the rail shown in FIG. 1, with the electrical box back-plate pivoted to one side.

In some instances electrical box 16 may include a backplate 32 that can be opened (as shown in FIG. 8) to allow wiring from the fixture to extend out the top of electrical box 16 so that once rail 10 is positioned within the T-bar framework, wires can be fed from elsewhere into the box to connect with the fixture wires. Making the connections in this manner can be simpler as the worker can stand on a ladder and work on the wiring within the electrical box from above, rather than standing below it and working over his or her head. Since the ceiling panels need not be installed during such wiring, the chance of marking or soiling the panels during fixture installation is reduced.

Alternatively, when a fixture or other device 30 is installed in the electrical box with rail 10 on the floor or on a workbench, lead or "tail" wiring can be wired into the box so that when rail 10 is positioned within the T-bar framework, there is no need to form any connections at the actual fixture or electrical box 16. The lead or tail can be routed to a centralized junction box to be connected with similar leads or tails from other fixtures or devices.

Rail 10 thus presents a rigid structure from which a fixture or other device, such as a lighting fixture, alarm, etc., can be hung without causing the T-bar drop ceiling structure and/or its panels or tiles to be deflected downward. Traditionally, others have had to support such fixtures directly from the structural ceiling above the T-bar framework, cut wood to be spaced between the T-bar rails to which the fixtures and/or electrical boxes can be secured, or use other forms of metal holders or supports that would span from one T-bar rail to another. Rail 10 largely eliminates the need for those other suspension structures, presents a visually appealing support, and reduces labour involved in the installation of lighting fixtures, etc. With rail 10 there is no need to cut intricate shapes or holes within ceiling panels 13 to accommodate fixtures or other devices. Rail 10 is merely inserted between two adjacent T-bar rails and/or replaces a standard T-bar rail, with a fixture attached, and thereafter the ceiling tiles overlay supports 24. Since the fixture installer need not physically touch the tiles, the likelihood of the tiles becoming soiled is greatly diminished.

As described above, rail 10 can also be used for the installation of sprinkler heads. Traditionally, the main supply lines for a sprinkler system are installed without the sprinkler heads, which are not installed until the ceiling tiles or panels are put into place. The sprinkler installers must wait for the ceiling panels to be installed before they can install the sprinkler heads so that they can ensure that the heads are located at their correct elevation. According to the current disclosure, rail 10 can be placed between adjacent T-bar rails before the ceiling panels are installed. To accommodate sprinkler heads, the previously described embodiment of rail 10 can be used, without electrical box 16 attached thereto, and with opening 14 dimensioned to accommodate a sprinkler head. The sprinkler installers will be able to insert a trim ring about the head and next to lower surface 20 of member 12 and ensure the correct elevation of the T-bars and rails 10, before ceiling panels are installed. Without the ceiling panels in place, the installers will have ample room to physically work around the sprinkler drops and to install the sprinkler heads and trim plates, removing the necessity for the sprinkler installers to return at a later time to install the heads and the trim plates, once again reducing installation costs. As in the case of the installation of an electrical fixture, there is no need for sprinkler installers to come into contact with the actual ceiling tiles or panels, reducing the likelihood of the panels becoming dirtied.

It will be appreciated that through alternate embodiments of the invention, any one of the very wide variety of different fixtures or devices could be supported by or incorporated into a suspended ceiling.

It is to be understood that what has been described are exemplary embodiments of the invention. The scope of the claims should not be limited by the embodiments set forth above, but should be given the broadest interpretation consistent with the description as a whole.

The invention claimed is:

1. A rail for supporting one or more ceiling tiles in a suspended ceiling, the rail comprising:

an elongate plate for supporting the one or more ceiling tiles, said elongate plate having an upper and a lower surface and having formed therein an opening extending between said upper and lower surfaces;

an electrical box aligned with said opening and welded to said upper surface; and said elongate plate having two opposed and parallel longitudinal edges and two flange portions on said upper surface, said flange portions substantially perpendicular to said upper surface and on opposite sides of said opening, said flange portions extending longitudinally along said upper surface adjacent and parallel to said longitudinal edges, said elongate plate having a ceiling tile support adjacent to each of said flange portions.

2. The rail of claim 1 wherein each of said flange portions abuts an edge of one of a ceiling tile when the ceiling tile is received on said ceiling tile support to facilitate alignment of the ceiling tile with said elongate plate.

3. The rail of claim 1 wherein said flange portions extend longitudinally, substantially along a length of said elongate plate.

4. The rail of claim 1 wherein each flange portion includes one or more attachment means for attachment to a suspension means for hanging said rail from an overhead structure.

5. The rail of claim 4 wherein said attachment means comprises holes formed in said flange portions.

6. A suspended ceiling comprising:

an elongate plate supporting one or more ceiling tiles, said elongate plate having an upper and a lower surface with an opening extending between said upper and lower surfaces, said opening accommodating a sprinkler head mounted to a structure above the suspended ceiling; and said elongate plate having two opposed and parallel longitudinal edges and two flange portions on said upper surface, said flange portions substantially perpendicular to said upper surface and on opposite sides of said opening, said flange portions extending longitudinally along said upper surface adjacent and parallel to said longitudinal edges, said elongate plate having a ceiling tile support adjacent to each of said flange portions.

* * * * *